United States Patent [19]

Gilbert

[11] 4,193,460

[45] Mar. 18, 1980

[54] PERFORATING GUN WITH PAIRED SHAPED CHARGER VERTICALLY SPACED

[76] Inventor: Bruce Gilbert, 2508 Durham, Brownwood, Tex. 76801

[21] Appl. No.: 925,369

[22] Filed: Jul. 17, 1978

[51] Int. Cl.[2] ..... E21B 43/117

[52] U.S. Cl. ..... 175/4.6; 102/21.6; 175/4.51; 175/4.57; 102/20

[58] Field of Search ..... 175/2–4.6; 102/20, 21.6

[56] References Cited

U.S. PATENT DOCUMENTS

| | | | |
|---|---|---|---|
| 2,984,307 | 5/1961 | Barnes | 102/20 X |
| 3,013,491 | 12/1961 | Poulter | 102/20 |
| 3,089,416 | 5/1963 | Gilbert | 175/4.6 |
| 3,101,051 | 8/1963 | Gilbert | 175/4.6 |
| 3,415,321 | 12/1968 | Venghiattis | 175/4.6 X |
| 3,739,723 | 6/1973 | Hakala | 102/20 |
| 4,011,815 | 3/1977 | Garcia | 175/4.55 X |

*Primary Examiner*—Ernest R. Purser
*Assistant Examiner*—Nick A. Nichols, Jr.
*Attorney, Agent, or Firm*—James E. Bradley

[57] ABSTRACT

A perforating gun for perforating earth formations, primarily in oil and gas wells. The gun includes a straight metal tube in which explosive jet charges are carried. A mounting apparatus within the tube holds the charges in pairs, the pairs being spaced vertically from each other. The charges within a pair point in the same general direction. The axis of each charge within a pair lies in a common horizontal plane with the axis of the other charge in the pair. The gun is operable with a decentralizer that places it in contact with the casing wall for firing. An alignment device within the gun assures that the charges are all pointing toward the nearest wall.

6 Claims, 5 Drawing Figures

PERFORATING GUN WITH PAIRED SHAPED CHARGER VERTICALLY SPACED

BACKGROUND OF THE INVENTION

1. Field of the Invention

This invention relates in general to equipment for perforating earth formations in cased wells, and in particular to an improved perforating gun.

2. Description of the Prior Art

There are several devices commonly used in perforating wells in the oil and gas industry. All of these devices are lowered into the well on insulated conductor cable. One type, known as a casing gun, comprises a thick metal pipe with a number of threaded ports. Jet explosive charges, known as shaped charges, are placed in the pipe in alignment with the ports. Threaded plugs are then secured in the ports. When at the desired depth, the charges are initiated by fuse cord and a detonator. The jet pierces the threaded plug, well casing, cement, and travels into the earth formation. The gun is retrieved and reused with new plugs.

One disadvantage of casing guns is that they are expensive due to material and labor cost in manufacturing the gun. Cleaning and reloading is time consuming, and numerous parts must be replaced such as the plugs and O rings.

Another type, commonly called a scallop gun, comprises a metal tube of diameter sufficiently small to be lowered through tubing. Shaped charges are carried inside the tube. Concave scoops are located on the outer surface of the tube adjacent each charge. When detonated, the jet pierces the tube wall, the well casing, cement, and earth formation. The tube is then retrieved and discarded. The depressions prevent burrs from protruding too far, and also reduce the thickness that the jet has to pierce before entering the well casing.

One disadvantage of the scallop gun is that it must be relatively thin compared to casing guns in order to be run through tubing. The compressive forces caused by the detonation could cause the tube to rupture, preventing if from being retrieved from the well. In order to avoid rupturing due to the detonation, expensive, high strength, heat treated steel is used. Since the gun has to be discarded after a single use, this technique is relatively expensive.

Another disadvantage with both types is that only a single charge is located at a particular depth. Although there may be several charges to a vertical foot, all of the charges are spaced one above the other. As explained in detail in my prior U.S. Pat. No. 3,089,416, perforating can cause or induce fracturing. If the charges are closely spaced vertically, the tendency is for the fracture to be induced vertically. Vertical fractures in the formation can be detrimental since they may lead into water bearing zones, causing more water to be produced along with the oil. On the other hand, horizontal fractures are beneficial, since they increase formation exposure at the desired point of production.

In my prior patent, I disclose a cluster of four charges that are especially oriented to induce or cause horizontal fracturing. The shock waves from a pair of horizontal parallel jets are added to the shock waves from upper and lower converging jets to cause the desired fracturing effect. That device, however, utilizes an expendable, non-retrievable housing. The detonation of the charge disintegrates the gun housing. Pieces from the metal housings of the charges and the gun housing may migrate with the well flow, causing clogging of the production equipment. Also it can fire only a single cluster in one run. It is a special purpose gun to be used only prior to hydraulic fracturing for controlling the fracture.

SUMMARY OF THE INVENTION

It is accordingly a general object of this invention to provide an improved perforating gun.

It is a further object of this invention to provide an improved expendable, but retrievable perforating gun.

It is a further object of this invention to provide an expendable, retrievable perforating gun that positions the charges so as to induce horizontal fracturing.

In accordance with these objects, a perforating gun is provided that includes a straight metal tube. Charges are mounted in the tube in pairs that are vertically spaced apart. Both of the charges with a pair point generally in the same direction. Within each pair, the axes of the charges lie in a common horizontal plane. The tube may be formed of conventional oil field tubing, but should be able to withstand disintegration and rupturing as it is retrieved after firing. The charges within the pair partly offset each other, avoiding rupturing and bending that could be caused by a single large charge.

The gun is run with a decentralizer. An alignment device connected with the mounting system assures that all the charges will point toward the nearest section of the casing wall.

DESCRIPTION OF THE PREFERRED EMBODIMENT

Figure 1:
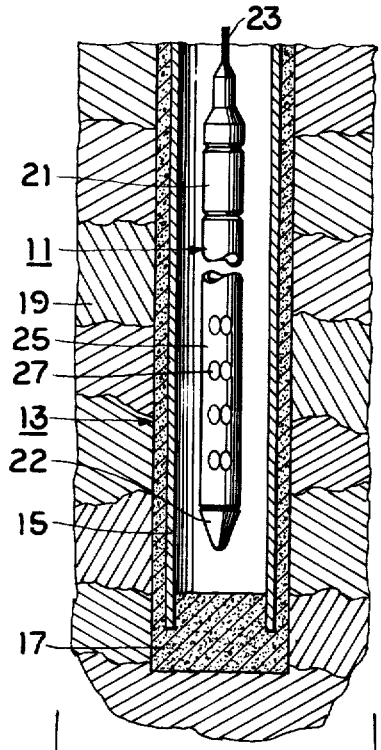
FIG. 1 is a side view of a perforating gun constructed in accordance with this invention, shown in a well.

Referring to FIG. 1, a perforating gun 11 is shown within a well 13. The well contains casing 15 surrounded by cement 17. Various formations in the earth are indicated by numeral 19. The gun 11 is connected to a decentralizer 21, which contains magnets to draw one side of the gun into contact with casing 15. A conventional casing collar locator (not shown), is connected with the decentralizer 21 and gun 11 to provide depth control. Weight bars (not shown) may also be connected above and below gun 11. A nose plug 22 is located at the bottom of gun 11, or if weight bars are used below, at the bottom of the weight bars. The gun is lowered and energized by insulated conductor cable 23.

The gun comprises a straight, hollow steel tube 25, which may be N-80 grade tubing, a typical tubing used for the production string in oil and gas wells. A plurality of scallops or concave external depressions 27 may be formed in the surface of the tube 25. "Concave" is defined herein to include a curved plane and is not limited to a configuration defined by the inner surface of a portion of a sphere. Scallops 27 are formed in pairs, spaced vertically apart. The scallops 27 within a single pair are on the same horizontal level. The terms "vertical" and "horizontal" are defined herein to be with reference to the length of the gun, although at times the gun will be operated in deviated wells, thus not in truly vertical orientations.

Figure 2:
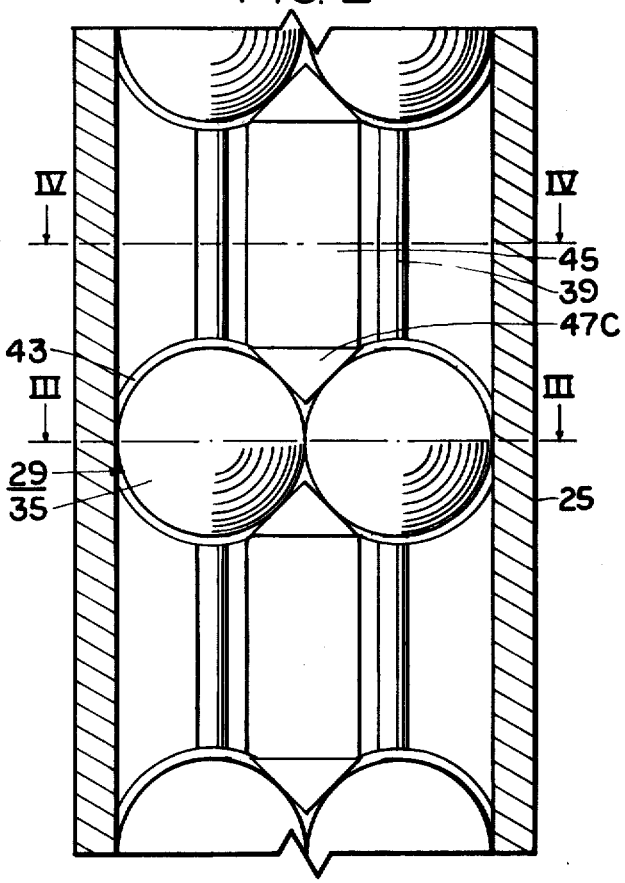
FIG. 2 is an enlarged partial vertical sectional view of the perforating gun of FIG. 1.

Referring also to FIGS. 2-5, a plurality of explosive jet charges or shaped charges 29 are carried in tube 25. Shaped charges 29 are of conventional design, but have been modified for use with gun 11. Each comprises a housing of dense material such as steel having a generally cylindrical forward portion 31*a* and a conical base or rear portion 31*b*. The cylindrical portion 31*a* tapers inward slightly from the rear portion forwardly. The mouth of the cylindrical portion is open. A mass of compacted explosive powder 33 is contained within housing 31 and is secured by a conical liner 35 in the mouth of the cylindrical portion 31*a*. Liner 35 is fairly thin and made of a metal such as copper. A rectangular vertical passage 37 at the rear of the base 31*b* is adapted to receive fuse cord, often called prima cord 39. The prima cord 39 is separated from powder 33 by a thin seal 41 in passage 37. As shown in FIG. 2, the cylindrical portion 31*a* has an annular band or shoulder 43 protruding from its surface. A portion of band 43 has been removed on each side to enable the charges 29 in a pair to contact each other along their cylindrical portions 31*a*.

Figure 3:
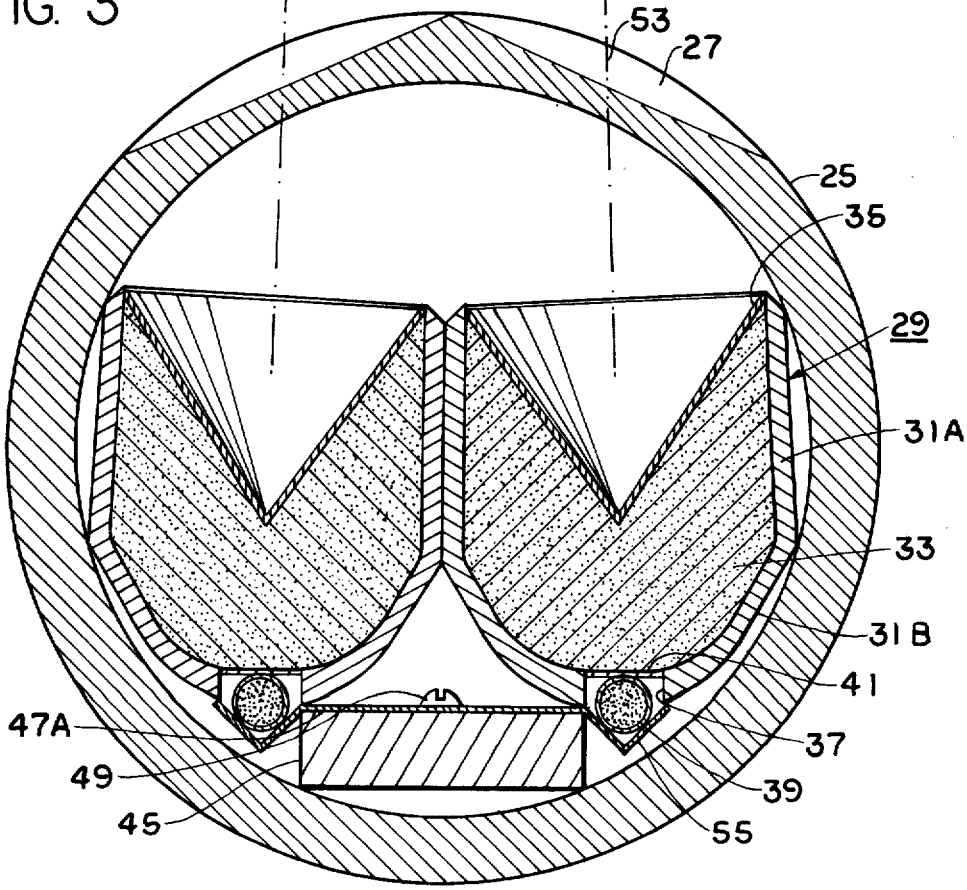
FIG. 3 is an enlarged sectional view of the perforating gun of FIG. 1, taken along the line III—III of FIG. 2.
Figure 5:
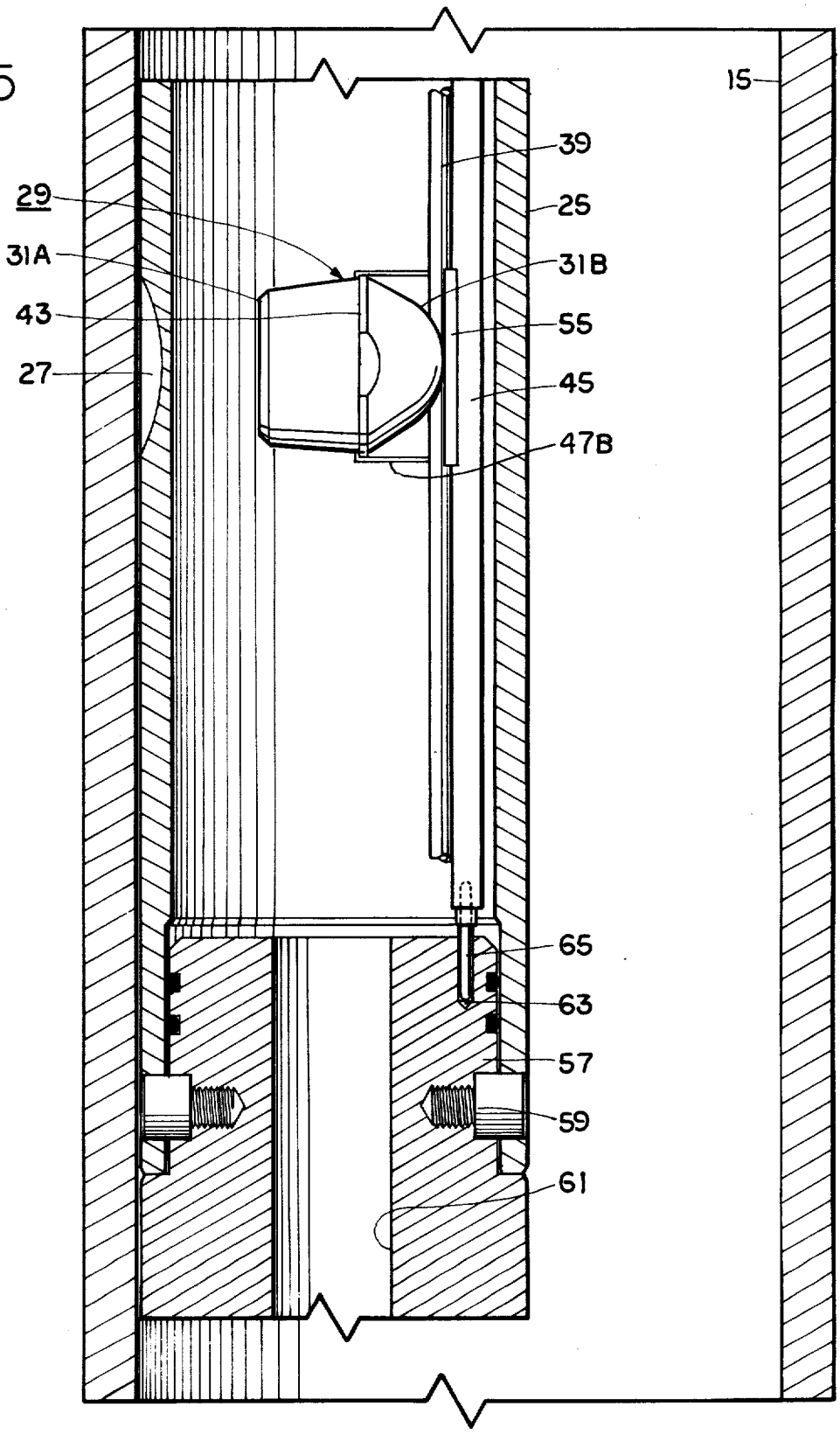
FIG. 5 is a partial vertical sectional view of the perforating gun of FIG. 1, taken in a plane perpendicular to the sectional view of FIG. 2.

Each pair of charges are secured in place by a single-piece bracket which in turn is connected by a rectangular bar 45 that is substantially the length of tube 25. Referring to FIG. 5, the bracket has a rear vertical plate 47*a* that is connected to bar 45 by a screw 49 (FIG. 3). Upper and lower horizontal plates 47*b* extend forwardly from the rear vertical plate 47*a*. Horizontal plates 47*b* extend forwardly for a distance approximately equal to the length of the conical base 31*b*. The horizontal plates bend 90° into upper and lower triangular vertical plates 47*c*. The upper vertical plate 47*c* extends downwardly, and the lower vertical plate 47*c* extends upwardly. As shown in FIG. 2, the upper and lower vertical plates 47*c* terminate in opposing points. The horizontal plates 47*b* are spaced apart a sufficient distance to closely receive a pair of shaped charges 29 between them. The vertical plates 47*c* fit directly forward of bands 43, securing the shaped charges to the bar 45. The bracket is constructed of sheet metal, and is sufficiently resilient to grip the charges.

Figure 4:
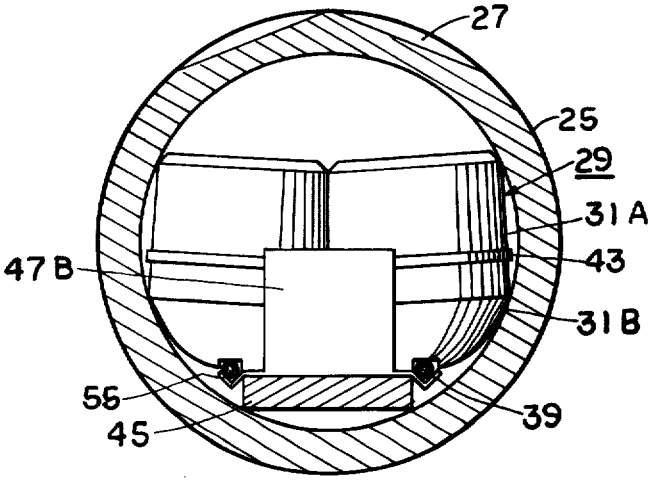
FIG. 4 is a sectional view of the perforating gun of FIG. 1, taken along the line IV—IV of FIG. 2.

As shown in FIG. 4, the charges are held so that their cylindrical portions 31*a* contact. Each cylindrical portion 31*a* tapers inward at an angle of approximately 3°, consequently the axes 53 (FIG. 3) of the charges converge toward each other at an included angle of approximately 6°. The axes 53 of each charge within a single pair lie in a common horizontal plane that is perpendicular to the length of tube 25. Although the jets will converge slightly toward each other, they will be pointing in the same general direction.

Also, the bracket has two prima cord retainers 55 formed on each side of the rear vertical plate 47*a*. Retainers 55 are simply two folds or channels on the vertical plate 47*a*, formed in a manner to provide a triangular backing to keep the prima cord in close proximity to seal 41.

FIG. 5 disclosed part of the alignment means for orienting the charges so that they are all behind a scallop 27 and pointing toward the part of the casing to which the gun has been drawn. The portion shown in FIG. 5 is the lower portion of the gun, the upper portion not being shown since it is identical. Both the upper and lower ends of the tube 25 will be sealed by a male connector 57. Connector 57 seals from well fluid and also connects the tool to other members of the perforating string, such as the decentralizer 21, nose plug 22, weights, or a casing collar locator. Each connector 57 comprises a thick-walled cylindrical member, with threads for fastening to tube 25 through screw 59. Normally connector 57 has a central passage 61 for the passage of electrical wires. The upper end of the connector 57 has a cylindrical hole 63 formed on one side of passage 61. Bar 45 has a cylindrical pin 65 extending from each end that is adapted to be closely received in hole 63. The length of bar 45 is selected so that there is very little play when the upper and lower pins 65 are fully inserted into upper and lower connectors 57.

In operation, the gun is prepared by fastening the brackets to the bar 45 by screws 49. Various vertical spacings can be used, up to four brackets per foot. The prima cord is drawn along the retainers and shaped charges are clipped into the brackets between the horizontal vertical plates 47*b* and 47*c*. The assembled bar and charges are then placed inside tube 25. On one end the two pieces of prima cord are drawn together and evenly cut. A single booster charge (not shown) is placed against the squarely cut exposed ends. A sleeve is crimped over the prima cord pieces and the booster to retain them in abutment. A single electrically actuated detonator (not shown) is crimped onto the booster since it is essential that the charges initiate simultaneously. Either the upper or the lower connector 57 is pushed into tube 25, with the hole 63 located opposite the side that the decentralizer favors. This will also be opposite the scallops 27, which is the side that will be in contact with the well casing. The operator then pushes the bar 45 from the opposite end until pin 65 seats in hole 63. The connector on that end is then aligned with its hole 63 opposite pin 65, pushed into place, and locked by screws in threads 59. Prior to locking, wires leading to the detonator must be admitted through the upper connector 57.

The gun is lowered into the well through casing opposite the formation 19 desired to be perforated. Electrical current is supplied to the detonator, which detonates the two pieces of prima cord, which in turns simultaneously intiates the shaped charges. The jets are directed through the scallops 25 and into the formation. After firing, the gun is withdrawn, retrieving along with it the particles from the disintegrated charges.

At times, the perforating itself will cause a horizontal fracture. At other times, it may only induce a fracture that may be achieved by conventional hydraulic fracturing. Hydraulic fracturing entails pumping fluid against the formation at very high pressures. The holes formed in the formation by shaped charges taper inwardly forming a slightly conical hole. The converging jets maintain approximately the same web thickness between the conical holes as they proceed into the formation. Maintaining the same web thickness provides uniformly higher stress than in other planes, thus inducing fracture in this plane.

It should be apparent that an invention having significant advantages has been provided. The gun is considerably less expensive than casing and scallop guns, since it does not have to be made from steel that has as much strength as is used conventionally. It is believed that the pair of charges allows more explosive force to be used without rupturing. A single large charge in the same tube having the same amount of powder as two smaller charges combined would likely cause the tube to rupture. When a charge detonates compressive forces are directed radially outward of magnitude depending partially on the amount of powder. The gun walls on each side of the charge will tend to bulge outward and may rupture. However, with the pair arrangement, the forces generated between the charges tend to counter each other, leaving only the forces on the outer sides of the charges. These forces are of less strength then the outward forces of a larger shaped charge. This allows lower strength steel to be used than with conventional guns that use single, large charges.

The perforating gun has the added advantage of tending to cause horizontal fracturing, as previously discussed, and is used as a conventional perforator, unlike the device of my prior patent. Another advantage is that penetration is enhanced through an improved standoff. It is known that better penetration results if the distance between the charge and the first barrier is at the optimum distance for that type of charge. If less, the penetration rate is diminished. However in conventional guns, the performance is penalized since the optimum standoff is sacrificed in order to obtain larger size charges. Normally the standoff used is less than the optimum. In the gun of this invention, the charges are relatively small compared to the tube and their bases are located close to the wall of the tubing. This spacing yields a standoff closer to the optimum than in conventional guns. Good penetration is obtained, and also greater formation exposure results since two holes are created.

While the invention has been shown in only one of its forms, it should be apparent to those skilled in the art that it is not so limited but is susceptible to various changes and modifications without departing from the spirit thereof. For example, the scallops may be omitted since the gun of this invention is normally to be run through casing and not through tubing. The burrs will not be detrimental since clearances are fairly large. Also, although in each pair, the charges must face in the same general direction, some of the pairs could face in directions different from other pairs. In addition, a single pair of charges could be located in a tube. If desired, multiple tubes fired selectively could be run.

I claim:

1. An improved perforating gun for perforating earth formations through a well casing wall with explosive jet charges, comprising:

a straight metal tube;

a rectangular bar extending substantially the length of the tube and secured inside the tube; and a plurality of bracket means for securing the charges to the bar in horizontal pairs that are vertically spaced apart each charge in each pair being in substantial contact with the other charge in the pair, the bracket means orienting all of the charges in the same direction and locating each charge within a pair so that its axis lies in a common plane with the other charge in the same pair, the common plane being perpendicular to the longitudinal axis of the tube;

the tube being of the type that will withstand disintegration when the charges are initiated allowing it to be retrieved to the surface;

the gun being adapted to be coupled to a decentralizer means for placing the gun in contact with a portion of the well casing wall, and including alignment means coupled to the bar for assuring that the charges all face the portion of the wall that the gun is contacting.

2. An improved perforating gun for perforating earth formations through a well casing wall with explosive jet charges, comprising:

a straight metal tube;

a rectangular bar extending substantially the length of the tube and secured inside the tube; and a plurality of bracket means for securing the charges to the bar in horizontal pairs that are vertically spaced apart, the bracket means orienting all of the charges in the same direction and locating each charge within a pair so that its axis lies in a common plane with the other charge in the same pair, the common plane being perpendicular to the longitudinal axis of the tube;

the tube being of the type that will withstand disintegration when the charges are initiated allowing it to be retrieved to the surface;

the gun being adapted to be coupled to a decentralizer means for placing the gun is contact with a portion of the well casing wall, and including alignment means coupled to the bar for assuring that the charges all face the portion of the well casing wall that the gun is contacting; the bracket means comprising:

upper and lower horizontal plates fastened to the bar and extending forwardly from the bar, the horizontal plates being parallel to each other and vertically spaced apart; and upper and lower vertical plates extending from the forward ends of the upper and lower horizontal plates, respectively, the upper vertical plate extending vertically downward and the lower vertical plate extending vertically upward, the horizontal and vertical plates being spaced apart a distance selected to closely receive a pair of the charges between them.

3. In an apparatus for perforating earth formations in a cased well with explosive jet charges, of the type including an insulated conductor cable for lowering a perforating gun into the well and supplying current thereto for initiating the charges, and a decentralizer for causing the gun to contact the casing wall, the perforating gun including a straight metal tube adapted to receive male connectors in its ends to seal the tube interior from well fluid and connect the tube to other members in the apparatus, an improved mounting means for mounting the charges in the tube comprising:

a rectangular bar of substantially the length of the tube carried inside the tube, the bar having a pin on each end, each male connector having a hole on its end adapted to receive the pin to secure the bar in alignment with the tube, the holes being located on the side opposite the side that the decentralizer causes to contact the casing; and a plurality of brackets fastened to the bar at selected vertical intervals, each bracket having upper and lower horizontal plates extending forwardly from the rod, and upper and lower vertical plates extending vertically and toward each other from the upper and lower horizontal plates, respectively, the horizontal and vertical plates being spaced apart a distance selected to receive and retain a pair of charges between them;

the tube having a plurality of concave external depressions on its outer surface, each aligned with a charge.

4. An improved perforating gun for perforating an earth formation through a well casing wall with explosive jet charges, comprising:

a tube;

mounting means for mounting all of the charges in the tube in pairs, each pair being separated from adjacent pairs on the tube's longitudinal axis, each charge within each pair being oriented generally in the same direction as the other charge in its pair to produce spaced apart perforations in the casing and formations with a substantially uniform web thickness between the perforations in each pair, the charges having their axes lying in a common plane that is perpendicular to the longitudinal axis of the tube, each charge within each pair being in substantial contact with the other charge in its pair for causing the perforations produced by a single pair to be sufficiently close to predetermine a fracture in a plane perpendicular to the longitudinal axis of the tube;

the tube being of material sufficient to withstand disintegration when the charges are detonated, allowing it to be retrieved to the surface after firing.

5. The perforating gun according to claim 4 wherein the mounting means comprises:

a bar extending substantially the length of the tube; and bracket means fastened to the bar for retaining the charges on the bar.

6. The perforating gun according to claim 5 wherein the gun is connected to decentralizer means for holding the gun in contact with a portion of the casing wall, and wherein the gun further comprises alignment means cooperating with the bar to assure that the charges are pointed toward the portion of the wall casing wall with which the gun is in contact.

* * * * *